United States Patent [19]

Ray

[11] Patent Number: 4,815,642

[45] Date of Patent: Mar. 28, 1989

[54] SKI BOOT CARRIER

[76] Inventor: Gene S. Ray, 2959 Jefferson St., Carlsbad, Calif. 92008

[21] Appl. No.: 49,848

[22] Filed: May 15, 1987

[51] Int. Cl.[4] ..... A45F 3/14

[52] U.S. Cl. ..... 224/258; 224/220; 294/162; 12/120.5

[58] Field of Search ..... 12/120.5; 36/1, 117; 294/149, 148, 150, 162, 158, 163, 170, 165; 224/917, 191, 202, 219, 220, 221, 222, 250, 255, 257, 258; 24/3 A, 3 M, 115 H

[56] References Cited

U.S. PATENT DOCUMENTS

| | | | |
|---|---|---|---|
| 272,067 | 2/1983 | Lindsay | 224/220 |
| 530,215 | 12/1894 | Weiss | 224/220 |
| 1,270,207 | 6/1918 | Preston | 224/250 |
| 1,660,740 | 2/1928 | Bailey | 224/258 |
| 2,273,136 | 2/1942 | Orech et al. | 224/258 |
| 2,356,209 | 8/1944 | Brilhart | 224/258 |
| 2,522,719 | 9/1950 | Johnson | 224/220 |
| 2,572,889 | 10/1951 | Strykower | 224/258 |
| 2,630,255 | 3/1953 | Finder | 224/258 |
| 2,947,456 | 8/1960 | Seron | 224/258 |
| 3,057,526 | 10/1962 | Jaquith | 224/258 |
| 3,186,611 | 6/1965 | Sonderman | 224/205 |
| 3,266,464 | 8/1966 | Davis | 224/258 X |
| 3,294,299 | 12/1966 | Brennan | 224/220 |
| 3,587,951 | 6/1971 | Derouin | 224/250 X |
| 3,600,734 | 8/1971 | Pollingen | 224/250 X |
| 3,797,075 | 3/1974 | Seron | 224/202 |
| 3,841,542 | 10/1974 | Hogensen, Jr. | 224/917 X |
| 4,242,813 | 1/1981 | Quance | 12/120.5 X |
| 4,244,498 | 1/1981 | Copp | 294/162 |
| 4,629,103 | 12/1986 | Miller | 224/250 |

FOREIGN PATENT DOCUMENTS

| | | | |
|---|---|---|---|
| 1116894 | 5/1956 | France | 224/220 |
| 340844 | 1/1931 | United Kingdom | 224/220 |

*Primary Examiner*—Henry J. Recla
*Assistant Examiner*—Ernest G. Cusick
*Attorney, Agent, or Firm*—Baker, Maxham & Jester

[57] ABSTRACT

A ski boot carrier comprises a double loop structure defined by a cord forming a first loop for looping through the buckles of a pair of adjacent ski boots, and a strap forming a second loop for looping over the arm of a skier for carrying the boots, leaving the hand of the arm free to grasp or carry other articles and the like.

5 Claims, 1 Drawing Sheet

SKI BOOT CARRIER

BACKGROUND OF THE INVENTION

The present invention relates to skiing equipment, and pertains particularly to a ski boot carrying device.

Ski boots are designed to protect the feet and ankles of a skier during his ski run. For this reason, ski boots are constructed to be very stiff in order to support the feet and ankles. Such boot structure, while ideal for skiing, is very uncomfortable during non-skiing conditions. The typical skier, while around a ski area, typically wears soft boots or shoes while not skiing, but must carry his ski boots to and from the ski area. While skis may frequently be left in public racks or the like around a ski lodge without danger of theft, this is not so for boots. Boots are extremely expensive and if left unattended are subject to theft.

A number of devices are available for enabling the skier to carry his boots. One such device comprises a central frame structure having a supporting base with a vertical panel with a handle at the top for grasping in the hand and with clamps on opposite sides for clamping the boots the vertical panel. Another form of carrier is referred to as a T-bar and comprises a loop which is looped through the buckles of the adjacent boots and comprises a T-handle which is grasped in the hands for carrying the boots.

Both of the above described structures are satisfactory, except when it is desirable to have the hand free to carry other objects and the like. For example, if the skier is carrying both the skis and the boots, both hands are fully occupied.

It is, therefore, desirable to provide a ski boot carrying apparatus which enables the carrying of a pair of boots, yet leaves the hands of the skier free.

SUMMARY AND OBJECTS OF THE INVENTION

It is the primary object of the present invention to provide an improved ski boot carrying device.

In accordance with the primary aspect of the present invention, a ski boot carrying device comprises a first loop for looping through the buckles of a ski boot and a second loop for looping over the arm of the skier for leaving the hand free for other tasks.

BRIEF DESCRIPTION OF THE DRAWING

The above and other objects and advantages of the present invention will become apparent from the following description when read in conjunction with the drawings wherein.

DETAILED DESCRIPTION OF A PREFERRED EMBODIMENT

Figure 1:
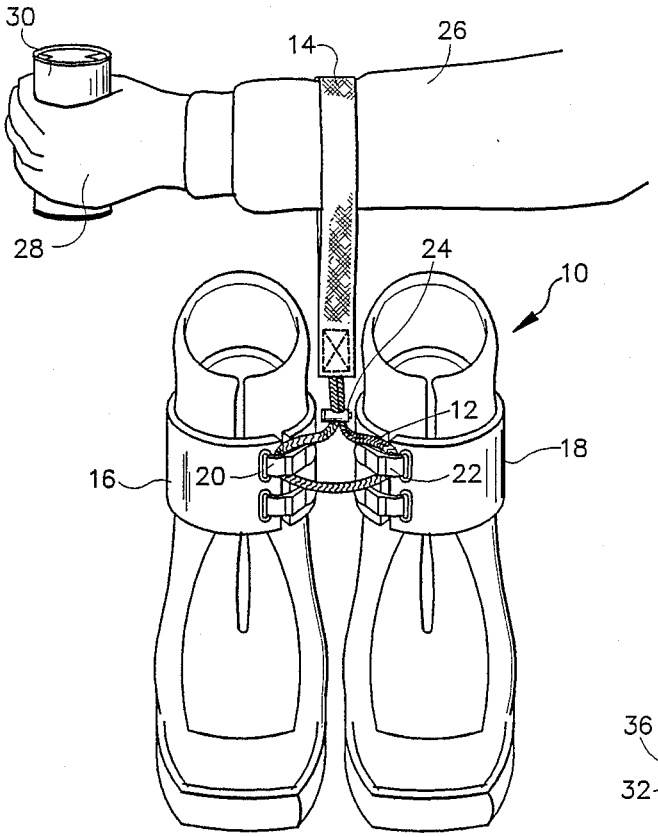
FIG. 1 is a perspective view showing the apparatus of the present invention in use.

Referring to FIG. 1, there is illustrated a boot carrier in accordance with the invention in use. The boot carrier, designated generally by the numeral 10, comprises a first loop 12, which loops through buckles of a pair of ski boots and a second loop to which the first loop is connected 14, which is looped around an arm of an individual. In an alternate embodiment, the strap 14 is made sufficiently long to loop over a shoulder. The strap would be on the order of about thirty-six to about forty inches in length to serve as a shoulder strap.

As will be appreciated from FIG. 1, the carrying strap of the present invention is designed to enable an individual to carry a pair of boots without the use of the hand, such that the hand is left free for other uses, such as the carrying of a drink or for other purposes. The loop 12 in the preferred embodiment has a length of somewhere on the order of between about five and ten inches in length from end to end, permitting the strap to loop through the buckles of a pair of adjacent boots 16 and 18. The loop in the usual use is looped through the upper buckles 20 and 22 of the pair of boots 16, 18. The loop includes a slip clamp 24 which is adapted to move downward on the loop to squeeze the loop into a smaller configuration to pull the boots together. This has the effect of pulling the boots together so that they act as a unit.

The strap 14 is preferaably constructed of a non-elastic flexible strap material, such as woven fabric or the like, such as fabric belting or the like, having a length on the order of about anywhere from fifteen to about twenty-five inches to enable it to loop over an arm and over the sleeves of sweaters, jackets and the like. A smaller loop may be desirable for shorter or smaller people and for use where heavy thick parkas and the like are not used. The longer loop may be desirable for larger people or in areas where heavy parkas are typically worn. Another embodiment may use a strap slightly longer, such as about thirty-six to forty inches for a shoulder strap.

As can be seen from FIG. 1, an arm 26 supports the loop 14 somewhere between the wrist and elbow thereof. The arm preferably extends outward substantially in a horizontal position as shown such that a hand 28 is free to grasp and hold articles, such as a beverage container or the like 30, as illustrated.

Figure 2:
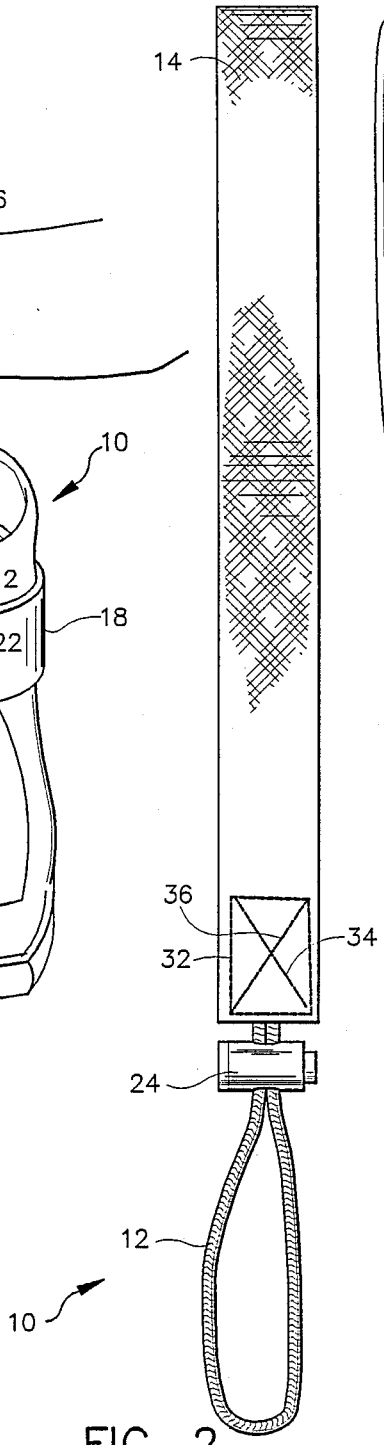
FIG. 2 is a top plan view showing the device.

Referring now particularly to FIG. 2, a more detailed illustration of the contruction and arrangement is illustrated wherein the strap 14 is preferably on the order of about one-sixteenth inch thick and an inch in width. Wider straps may be utilized if desired where a larger support area of the strap is deemed necessary. Although the strap 14 is preferably of woven fabric, it may also be constructed of leather, or other materials, such as plastics.

The loop 12 is preferably constructed of a cord, such as a flexible but non-elastic Nylon or the like cord, rope or the like having a diamter of on the order of from about one-eighth to about one-quarter of an inch.

In constructing the carrier, the two ends of the cord are brought together side by side and placed on overlapping relation with one end of the end of strap 14, and the other end of the strap laid over, and an area of overlapping is sewn with stitching in the form of for example a box-like arrangement of stitching 32 and a couple of cross stitches 34 and 36. This securely connects the ends of both loop members together, forming a permanent loop of each structure.

A cord clamp 24 is placed on the loop 12, such that the effective loop thereof can be changed, as previously explained, to shorten the distance or the length of the loop to pull a pair of boots together.

Figure 3:
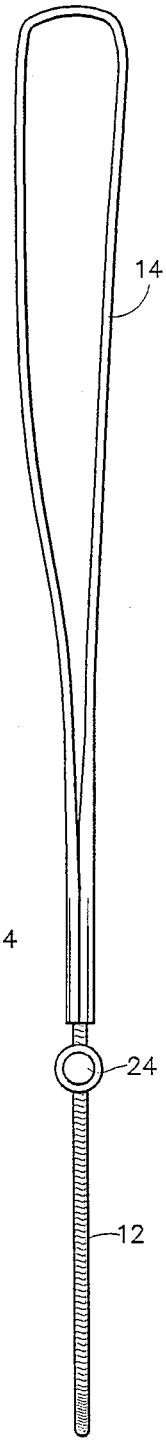
FIG. 3 is a side elevation view showing the device.

Referring to FIG. 3, a side view of the structure is illustrated showing the intersection of the ends of the two loops to show the overlap of the strap and the cord loops.

While I have illustrated and described my invention by means of a specific embodiment, it is to be understood that numerous changes and modifications may be made therein without departing from the spirit and scope of the invention as defined in the appended claims.

I claim:

1. A multiple loop carrying strap for ski boots and the like, comprising:

a single elongated flexible non-elastic cord having opposite ends secured together defining a first loop for extending through a buckle of each boot of a pair of adjacent ski boots; and an elongated flexible non-elastic strap having opposite ends thereof secured together and to the ends of said first loop for defining a second loop for looping over an arm of a person for supporting a pair of ski boots with the hand of said arm free; and clamp means adjustably mounted on said first loop for selectively dividing said single cord into two variable size secondary loops from said first loop.

2. A ski boot carrying strap according to claim 1 wherein:

said first loop means comprises a fabric cord having a length of about five inches.

3. A ski boot carrying strap according to claim 2 wherein:

said second loop comprises a fabric strap having a length of from about fifteen to about twenty inches.

4. A ski boot carrying strap according to claim 3 wherein:

said first loop is defined by a cord having a diameter of about one-eighth inch.

5. A multiple loop carrying strap for ski boots and the like on an arm or a shoulder comprising:

an elongated flexible non-elastic cord having a length of from five to ten inches, a diameter of about one-eighth of an inch, opposite ends secured together defining a first loop for extending through a buckle of each boot of a pair of adjacent ski boots;

clamp means on said first loop for adjusting the size of said loop for securing a pair of adjacent boots snugly together; and an elongated flexible non-elastic strap having a length from about fifteen to about forty inches, a thickness of about one-sixteenth of an inch, and a width of about one inch, with opposite ends thereof fixedly secured together and to the ends of said first loop for defining a second loop for looping over an arm or shoulder of a person for supporting a pair of ski boots with the hand of said arm free.

* * * * *